US007105082B2

(12) United States Patent
Hardikar

(10) Patent No.: US 7,105,082 B2
(45) Date of Patent: Sep. 12, 2006

(54) COMPOSITION AND METHOD FOR ELECTRODEPOSITION OF METAL ON A WORK PIECE

(75) Inventor: Vishwas Hardikar, Phoenix, AZ (US)

(73) Assignee: Novellus Systems, Inc., San Jose, CA (US)

( * ) Notice: Subject to any disclaimer, the term of this patent is extended or adjusted under 35 U.S.C. 154(b) by 160 days.

(21) Appl. No.: 10/377,488

(22) Filed: Feb. 27, 2003

(65) Prior Publication Data

US 2004/0168928 A1 Sep. 2, 2004

(51) Int. Cl.

| | |
|---|---|
| ***C25D 3/00*** | (2006.01) |
| ***C25D 3/56*** | (2006.01) |
| ***C25D 3/58*** | (2006.01) |
| ***C25D 5/18*** | (2006.01) |
| ***C09D 5/00*** | (2006.01) |

(52) U.S. Cl. ..... 205/261; 205/238; 205/239; 205/253; 205/259; 205/267; 205/271; 205/296; 205/93; 205/102; 205/105; 205/123; 205/125; 106/1.25; 106/1.26

(58) Field of Classification Search ..... 106/1.25, 106/1.26; 205/238, 239, 253, 259, 261, 267, 205/271, 296, 93, 102, 105, 123, 125
See application file for complete search history.

(56) References Cited

U.S. PATENT DOCUMENTS

| | | | | |
|---|---|---|---|---|
| 6,444,110 | B1 * | 9/2002 | Barstad et al. | 205/123 |
| 6,531,046 | B1 * | 3/2003 | Morrissey et al. | 205/219 |
| 2001/0015321 | A1 * | 8/2001 | Reid et al. | 205/103 |
| 2004/0074775 | A1 * | 4/2004 | Herdman et al. | 205/103 |
| 2005/0056537 | A1 * | 3/2005 | Chen et al. | 204/229.4 |
| 2005/0061679 | A1 * | 3/2005 | Hardikar | 205/291 |

FOREIGN PATENT DOCUMENTS

| | | | |
|---|---|---|---|
| JP | 58081988 A | * | 5/1983 |
| JP | 63079991 A | * | 4/1988 |
| JP | 2000248397 A | * | 9/2000 |

OTHER PUBLICATIONS

BASF, "Surfactants, Pluronic & Tetronic" (no month, 1999), pp. 1-37.*

BASF, "Pluronic® L62D Block Copolymer Surfactant", Technical Bulletin, © no month, 2002, page 1.*

BASF, Surfactants, Pluronic & Tetronic (no month, 1999), pp. 1-37.*

Consson, Lindman, Holmberg, and Kronberg, *Surfactants and Polymers In Aqueous Solution*, 176-180 (1998), no month.

*BASF Corporation, Surfactants* (*Pluronic* & *Tetronic*) (1999), no month.

* cited by examiner

*Primary Examiner*—Edna Wong
(74) *Attorney, Agent, or Firm*—Ingrassia Fisher & Lorenz, P.C.

(57) ABSTRACT

A composition for electrodeposition of a metal on a work piece, which electrodeposition is conducted at an electrodeposition temperature, is provided. The composition comprises a metal salt, a polymer suppressor having a cloud point, an accelerator and an electrolyte. If the cloud point is greater than the electrodeposition temperature, an anion is also present in an amount sufficient to lower the cloud point of the polymer suppressor to a temperature approximately no greater than the electrodeposition temperature.

39 Claims, 1 Drawing Sheet

COMPOSITION AND METHOD FOR ELECTRODEPOSITION OF METAL ON A WORK PIECE

TECHNICAL FIELD

This invention relates generally to electrodeposition of a metal and more particularly to a composition and method for substantially planar electrodeposition of metal on a work piece.

BACKGROUND OF THE INVENTION

The production of integrated circuits begins with the creation of high-quality semiconductor wafers. During the wafer fabrication process, the wafers may undergo multiple masking, etching, and dielectric and conductor deposition processes. In addition, metallization, which generally refers to the materials, methods and processes of wiring together or interconnecting the component parts of an integrated circuit located on the surface of a wafer, is critical to the operation of a semiconductor device. Typically, the "wiring" of an integrated circuit involves etching trenches and "vias" in a planar dielectric (insulator) layer and filling the trenches and vias with a conductive material, typically a metal.

In the past, aluminum was used extensively as a metallization material in semiconductor fabrication due to the leakage and adhesion problems experienced with the use of gold. Other metallization materials have included Ni, Ta, Ti, W, Ag, Cu/Al, TaN, TiN, CoWP, NiP and CoP.

Recently, techniques have been developed which utilize copper to form conductive features because copper is less susceptible to electromigration and exhibits a lower resistivity than aluminum. Since copper does not readily form volatile or soluble compounds, the copper conductive features are often formed using damascene processes. Generally, the copper conductive features are formed by creating a via within an insulating material, depositing a barrier layer onto the surface of the insulating material and into the via, depositing a seed layer of copper into the barrier layer, and electrodepositing a copper layer onto the seed layer to fill the via.

As the size of integrated circuits continues to decrease and the density of microstructures on integrated circuits increases, the need for precise wafer surfaces becomes more important. However, substantially planar deposition of copper is difficult in ULSI chip processing, especially when the feature sizes are about 2 μm wide and larger. To fill such wide features, it is often necessary to deposit relatively thick layers, typically 700 nm and greater over the rest of the work piece. A subsequent planarization process then is required to remove the thick excess deposition metal layers and to level the surface needed for further integrated circuit manufacturing. Such planarization processes typically include a chemical mechanical planarization process, which mechanically removes the thick excess metal layer, or a reverse polarity deposition process, which electrically removes the thick excess metal layer. Deposition of such thick layers of metal followed by a planarization process to subsequently remove the thick excess metal layer increases the costs of the electrodeposition process and decreases throughput.

Accordingly, it is desirable to provide a new composition and method for electrodeposition of a metal on a work piece. It is also desirable to provide a composition and method for electrodeposition of a substantially planar metal film on a work piece. It is further desirable to provide a composition and method for electrodeposition of a thin metal film on a work piece. Other desirable features and characteristics of the present invention will become apparent from the subsequent description and the appended claims, taken in conjunction with the accompanying drawings.

BRIEF DESCRIPTION OF THE DRAWINGS

The following drawings are illustrative of particular embodiments of the invention and therefore do not limit the scope of the invention, but are presented to assist in providing a proper understanding of the invention. The drawings are not to scale and are intended for use in conjunction with the explanations in the following detailed description. The present invention will hereinafter be described in conjunction with the appended drawing figures, wherein like numerals denote like elements, and.

DETAILED DESCRIPTION OF EXEMPLARY EMBODIMENTS

Figure 1:
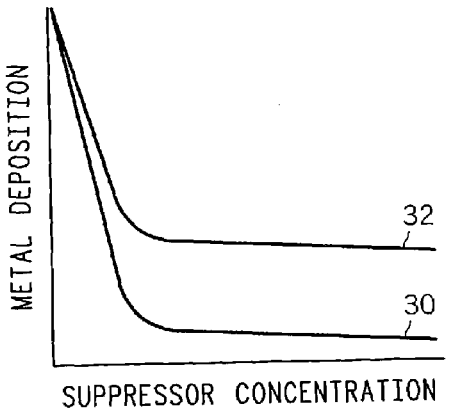
FIG. 1 is a graph illustrating the relationship between suppressor concentration and metal deposition in view of suppressor cloud point.

The following description is exemplary in nature and is not intended to limit the scope, applicability, or configuration of the invention in any way. Rather, the following description provides a convenient illustration for implementing exemplary embodiments of the invention. Various changes to the described embodiments may be made in the function and arrangement of the elements described herein without departing from the scope of the invention.

The present invention is directed to a composition and method for electrodeposition of a metal on a work piece. As used herein, unless otherwise specified, the term electrodeposition includes both the processes of electroplating and electrochemical mechanical deposition, also known as planar deposition. Electroplating typically involves conventional metal deposition using an electrolyte solution containing a metal, an anode and a cathode. A polishing step, typically a chemical mechanical polishing step, may be performed after deposition to obtain a planar surface of desired thickness. Electrochemical mechanical deposition uses a dedicated apparatus that selectively deposits the metal on the work piece to obtain a planar metal surface of a desired thickness.

Compositions for electrodeposition of a metal on a work piece in accordance with various embodiments of the present invention suitably comprise a metal salt, at least one polymer suppressor and an accelerator. The compositions also comprise an electrolyte, preferably an acidic aqueous solution, such as, for example, a sulfuric acid solution. The composition also may contain a variety of other components, such as, for example, one or more leveler agents.

In accordance with an exemplary embodiment of the present invention, the composition may also comprise an anion. It will be appreciated that the suppressor, being a polymer component, has a cloud point. Cloud point is defined as the temperature at which phase separation occurs for a 1% polymer solution. The electrodeposition is conducted at an electrodeposition temperature selected so that deposition of a metal on the work piece may occur. Typically, electrodeposition is conducted at temperatures in the range of about 15 to 40° C., although it will be appreciated that electrodeposition may occur at any suitable temperature. If the cloud point of the polymer suppressor is greater than the electrodeposition temperature, the composition may comprise an anion present in an amount sufficient to lower the cloud point to a temperature approximately no greater than the electrodeposition temperature.

By decreasing the cloud point of the polymer suppressor to a temperature no greater than the electrodeposition temperature, phase separation of the polymeric suppressor from solution and hence its adsorption onto the substrate is achieved. Without intending to be bound by theory, it is believed that the solubility of the suppressor decreases as the addition of anion increases. As the solubility of the suppressor decreases, the adsorption of the suppressor onto sites of nucleation increases. Since the mechanism of action of the polymeric suppressor molecule is the suppression or inhibition of metal deposition by adsorption of the suppressor molecule onto sites of nucleation, suppression increases as solubility of the polymer suppressor decreases.

In an alternative embodiment, a polymer suppressor having a cloud point that matches the electrodeposition temperature may be selected so that addition of an anion is unnecessary. In yet another alternative embodiment, a polymer suppressor having a particular cloud point may be selected and the electrodeposition temperature may be matched to the suppressor's cloud point. As used herein, two temperatures "match" each other when they differ by no more than 0.5° C.

FIG. 1 illustrates graphically the relationship between metal deposition on a work piece and suppressor concentration, where electrodeposition was conducted at 21° C. Curve 30 illustrates a polymer suppressor having a cloud point of 25° C. Curve 32 illustrates a polymer suppressor having a cloud point of 29° C. The graph illustrates that, at a given concentration of polymer suppressor, metal deposition from a metal electrolyte containing an anion is less, that is, suppression is more effective, for the polymer suppressor with the cloud point closer to the electrodeposition temperature.

Further, it will be appreciated that by selecting a polymer suppressor with a cloud point close to the electrodeposition temperature, only an amount of anion needed to lower the cloud point to a temperature no greater than the electrodeposition temperature is required. Limiting the amount of anion added to the composition may be desirable, as high concentrations of anions can be corrosive.

In one exemplary embodiment of the present invention, the anion comprises any suitable anion that is polarizable in an electric field. In a preferred embodiment, the anion comprises chloride ions, bromide ions, iodide ions and sulfate ions or a combination thereof. The anion concentration is typically within the range of 2–200 ppm.

In accordance with another exemplary embodiment of the present invention, a composition for electrodeposition of a metal on a work piece may be formulated such that the rate of deposition of the metal within the features is greater than the rate of deposition of the metal on the fields, even for features that are 2 μm wide and larger. As used herein, the rate of deposition is defined as the amount of metal deposited per unit of time, which for a known substrate area and metal density translates into thickness deposited per time, i.e., angstroms per minute.

In another exemplary embodiment of the present invention, the suppressor may suitably comprise any polymer suppressor formulated for preferential adsorption on the fields of the work piece, even at areas of fields next to relatively large features, that is, features no less than 2 μm in width. Polymer suppressors of the present invention are large molecules when compared to the molecules of the accelerators of the present invention and are electroinactive. Without intending to be bound by theory, and as discussed in more detail below, it is believed that the polymer suppressors of the present invention exhibit preferential adsorption on the fields of the work piece, even at areas of fields next to relatively large features, because the adsorption efficiency of the suppressors of the present invention is less than the adsorption efficiency of the accelerators of the present invention. As used herein, adsorption efficiency is defined as the rate of adsorption divided by the rate of desorption.

Figure 2:
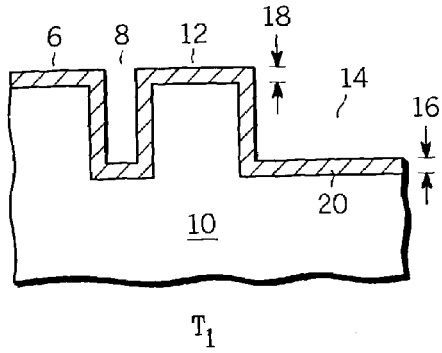
FIG. 2 is a cross-sectional view of a portion of a work piece having a metal film deposited thereon at a time $T_1$.
Figure 3:
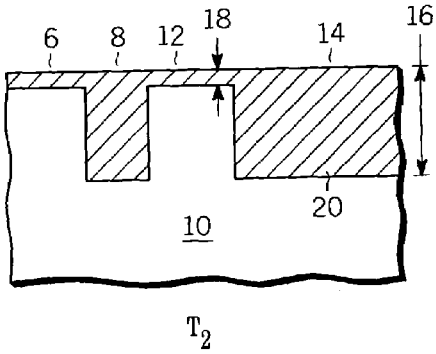
FIG. 3 is a cross-sectional view of a portion of a work piece having a metal film deposited thereon at a time $T_2$.
Figure 4:
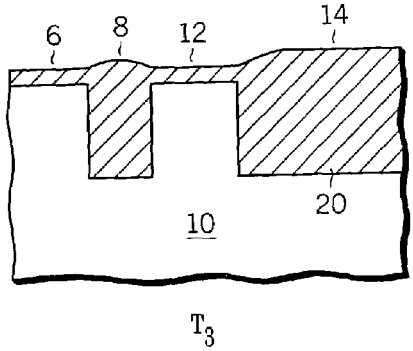
FIG. 4 is a cross-sectional view of a portion of a work piece having a metal film deposited thereon at a time $T_3$.

FIGS. 2–4 illustrate schematically the electrodeposition of metal on a work piece 10 using the composition of the present invention. As illustrated in FIG. 2, a work piece 10 has a field 6 that is adjacent to a feature 8 that is less than 2 μm wide. Work piece 10 also has a field 12 that is adjacent a feature 14 that is at least 2 μm wide. Although illustrated in FIGS. 2–4, feature 8 is not necessarily adjacent field 12. As illustrated in FIG. 2 and as used herein, a feature is any sub-surface element, character or surface, such as (but not limited to) a via or trench, formed within the work piece. A field is any adjacent element, character or surface that is elevated relative to the feature. At a time $T_1$, an initial layer 20 of metal is deposited overlying field 6 and field 12 and within feature 8 and feature 14 of work piece 10. The depth 18 of metal layer 20 overlying field 12 (otherwise referred to as the "overburden") is comparable to the depth 16 of metal layer 20 overlying the surface of feature 14. Referring to FIG. 3, because the composition is formulated such that rate of deposition of the metal within the features is greater than the rate of deposition on the fields, at a time $T_2$ when the surface of the metal layer 20 is substantially planar, the features 8 and 14 have been filled and the depth 18 of the overburden is considerably smaller than the depth 16 of the metal layer 20 overlying the surface of feature 14. Referring to FIG. 4, at time $T_3$, deposition of the metal is no longer substantially planar, as deposition within features 8 and 14 continues at an accelerated rate while deposition of the metal on fields 6 and 12 continues at a suppressed rate.

Accordingly, the composition of the present invention may be formulated so that the amount of overburden overlying the fields is reduced. This "single-step" electrodeposition thus eliminates the need for subsequent processing steps, such as wet etching, chemical mechanical planarization, reverse polarity etching and the like, to remove excessive overburden. The composition of the present invention may be formulated such that when the deposited metal film is substantially planar overlying the work piece, the metal film overlying a field is no greater than about 3000 angstroms.

Figure 5:
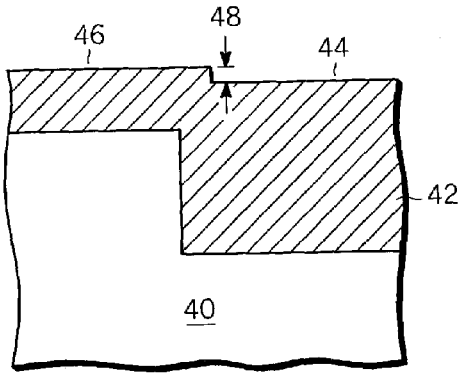
FIG. 5 is a cross-sectional view of a portion of a work piece having a metal film with a step height.

The composition of the present invention also may be formulated so that a metal film having a substantially planar surface may be deposited on a work piece without the need for subsequent processing steps, such as wet etching, chemical mechanical planarization, reverse polarity etching and the like. As used herein, a "substantially planar" surface means a surface having no step height greater than 1000 angstroms. FIG. 5 illustrates the principle of step height, wherein a step height 48 is the distance between a plane of a surface of a deposited metal layer 42 overlying, a field 46 of a work piece 40 and a plane of a surface of the deposited metal layer 42 overlying a feature 44. Preferably, the step height is no greater than 500 angstroms.

It will further be appreciated that the composition of the present invention may comprise two or more polymer suppressors of varying molecular sizes. As described above, polymer suppressors are typically large molecules. Since these molecules may be larger than the size of some features in the work piece, their diffusion into the smaller-size features is limited. Thus, deposition occurs at a faster rate in the smaller-size features than in those features in which the polymer suppressor molecules are able to diffuse. Accordingly, in this exemplary embodiment, the electrodeposition composition of the present invention may comprise polymer suppressors of varying average molecular size to accommodate features of varying geometries to facilitate planar deposition.

In a further exemplary embodiment of the present invention, the suppressor may comprise any suitable polymer suppressor that serves as a wetting agent. Acting as a wetting agent, the polymer suppressor permits faster spreading of the composition on the seed layer overlying the work piece. Thus, in small features, where typically voids may result without the presence of a wetting agent, the polymer suppressor is present in an amount sufficient to wet the walls of the feature but, because of its large molecular size, is not present in an amount sufficient to suppress deposition. In one embodiment of the invention, the polymer suppressor has a Draves wetting value in the range of 1 to 30 seconds. Draves wetting value is defined as the time required for a piece of waxed cotton yam to sink to the bottom of a 1% concentration solution at 25° C. In a preferred embodiment of the invention, the polymer suppressor of the composition has a Draves wetting value in the range of 1 to 15 seconds. In another embodiment of the invention, the polymer suppressor has contact angle in the range of 0 to 60° as measured for up to 1 minute. In a further embodiment of the invention, the polymer suppressor has a hydrophilic/lipophilic balance (HLB) value in the range of 1 to 15.

Suitable polymer suppressors in accordance with the various embodiments of the present invention may comprise any polymer that is soluble in water and has a molecular weight in the range of from 1000 to 2 million. In a preferred embodiment of the invention, the polymer suppressors comprise block copolymers of ethylene oxide and propylene oxide. Examples of block copolymers of ethylene oxide and propylene oxide that may be used in the compositions of the present invention include Pluronic®, Pluronic® R, Tetronic®, and Tetronic® R surfactants manufactured by BASF Corporation of Mount Olive, N.J. In a preferred embodiment of the invention, the polymer suppressors of the present invention comprise one or more of the surfactants Pluronic® L62LF, L72, L92, L122, 17R1, 25R1, 25R2, 31R1 and 31R2. The polymer suppressor portion of the electrodeposition composition typically comprises 0.001 to 10% by weight.

In one embodiment of the invention, the polymer suppressors have cloud points in the range of about 10 to 100° C. In a preferred embodiment of the invention, the polymer suppressors have cloud points in the range of about 15 to 40° C. In a more preferred embodiment of the invention, the polymer suppressors have cloud points in the range of about 19 to 25° C.

In accordance with another exemplary embodiment of the invention, the accelerator may be formulated for preferential adsorption on the features of the work piece, even relatively large features, that is, features no less than 2 μm in width. Without intending to be bound by theory, it is believed that a number of factors may be responsible for this phenomenon. Accelerators of the present invention are small molecules when compared to the large molecules of the polymer suppressors of the present invention and are electroactive. Polymer suppressor molecules are large molecules and once adsorbed onto nucleation sites, are not easily desorbed. Because the adsorption efficiency of the accelerator is greater than that of the suppressor, deposition is greater where adsorption of the accelerator is greater. Further, when an accelerator molecule and a suppressor molecule compete for a site of nucleation, the accelerator dominates. It is further hypothesized that, during deposition, current flows to the areas of least resistance, which is the areas of the features. The accelerator molecules, being electroactive, thus may be attracted to the features, thereby accelerating deposition in the features. It is also hypothesized that, in electrochemical mechanical deposition, where a contact surface moves the composition around the surface of the work piece, the smaller, more mobile accelerator molecules are more likely to be moved into the features, leaving the suppressor molecules adsorbed on the fields.

In accordance with a further exemplary embodiment of the invention, the accelerator may also be formulated so that it lowers the energy barrier required to cause deposition of the metal on the work piece. The accelerator may serve as a complexing agent that forms stable complexes with the metal. While the metal may deposit on the work piece at a standard reduction potential, the metal may form a complex with the accelerator with a reduction potential less than the standard reduction potential. Thus, less electricity may be required during the electrodeposition process to break the bonds of the accelerator/metal complex and deposit the metal onto the work piece. Alternatively, an accelerator can be selected so that an accelerator/metal complex is formed requiring a particular reduction potential. Depending on the value of this reduction potential, the amount and length of current supplied to the electrodeposition process can be varied so that the metal is deposited in varying grain size. For example, when current is supplied at 3 amps for 60 seconds, metal of a first grain size will be deposited and when the current is then changed to 6 amps for 30 seconds, metal of a second grain size will be deposited.

Suitable accelerators in accordance with the various embodiments of the present invention comprise compounds that contain one or more sulfur atoms and have a molecular weight of about 1000 or less. In one exemplary embodiment of the invention, the accelerators may comprise compounds having the formula H—S—R, where R is an electron donating group that may increase electron density on the sulfur atom and impart stability to the accelerator anion that is created in solution. Examples of the R group comprise:

-D (deuterium), $—CH_3$, $—CH_2—CH_3$, $(—CH_2)_n—R'$, where $n \geqq 1$, $$—CH_3—\underset{\displaystyle |}{CH}—CH_3,\ —O^-,\ —C—O—O^-;$$

-continued

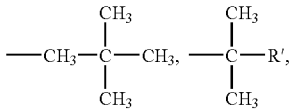

where R' is any electron-donating group. Other examples of the R group may comprise:

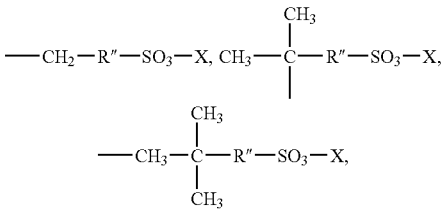

where R" is an optionally substituted alkyl group and X is a counter ion such as sodium or potassium. In an exemplary embodiment of the invention, the accelerator comprises a metal salt of 2-mercaptoethane sulfonic acid (HS—$(CH_2)_2$—$SO_3$-M) or 3-mercaptopropane sulfonic acid (HS—$(CH_2)_2$—$CH_2$—$SO_3$-M), where the metal salt may comprise sodium, potassium, ammonium, and the like.

A variety of metals may be deposited using the compositions of the present invention, including copper, aluminum, Ni, Ta, Ti, W, Ag, Cu/Al, TaN, TiN, CoWP, NiP and CoP. In a preferred embodiment of the present invention, the composition comprises copper salts. A variety of copper salts may be employed in the various embodiments of the compositions of the present invention, including, for example, copper sulfates, copper acetates, copper fluoroborate, and cupric nitrates. A copper salt may be suitably present in a relatively wide concentration range in the electrodeposition compositions of the present invention. Preferably, a copper salt will be employed at a concentration of from about 10 to about 300 grams/liter of composition.

Figure 6:
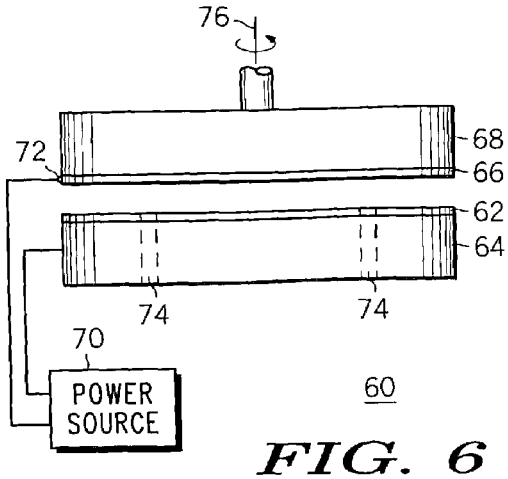
FIG. 6 is a cross-sectional view of an exemplary electrodeposition apparatus.

The following example illustrates a method, in accordance with one embodiment of the invention, for performing substantially planar deposition of a metal on a work piece using the composition of the present invention. The composition of the present invention may be used in a variety of deposition apparatus known in the industry. For purposes of this example, use of the composition of the present invention during an electrochemical mechanical deposition process will be described. A schematic representation of an electrochemical mechanical deposition apparatus 60 is illustrated in FIG. 6. To effect substantially planar electrochemical deposition, apparatus 60 utilizes a contact surface 62 supported by a platen 64. A work piece 66, such as a semiconductor wafer, may be urged against contact surface 62 by a wafer carrier assembly 68. Platen 64 may be fabricated from a conductive material, such as copper, tantalum, gold or platinum or may be formed of an inexpensive material, such as aluminum or titanium, and coated with a conductive material. Using a power source 70, the apparatus applies a negative potential to the work piece 66, via a cathode contact 72, and a positive potential to the platen 64, which acts as an anode. The cathode contact 72 may comprise one or more contacts and may contact work piece 66 by a variety of methods. For example, contact 72 may be insulated and disposed within platen 64 to contact the face of work piece 66 or may be remote from platen 64 and may contact the face of work piece 66 at its edges.

Platen 64 may be connected to a driver or motor assembly (not shown) that is operative to rotate platen 64 and contact surface 62 about a vertical axis. It will be appreciated, however, that the driver or motor assembly may be operative to move platen 64 and contact surface 62 in an orbital, linear or oscillatory pattern or any combination thereof. Similarly, wafer carrier 68 may be connected to a driver or motor assembly (not shown) that is operative to rotate wafer carrier 68 and work piece 66 about a vertical axis or to move wafer carrier 68 and work piece 66 in an orbital, linear or oscillator pattern or any combination thereof.

Platen 64 may have one or more channels 74 for the transportation of the composition of the present invention to the surface of the contact surface 62 from a manifold apparatus (not shown) or any suitable distribution system. Alternatively, it will be appreciated that the composition of the present invention may be deposited directly on or through the contact surface 62 by a conduit or any suitable application mechanism.

The method for performing substantially planar deposition of a metal on a work piece comprises selecting a deposition temperature, that is, the predominant or average temperature at which the deposition process will be conducted. An electrodeposition composition is formulated comprising a metal salt, a suppressor, an accelerator, and an electrolyte. In one exemplary embodiment, the suppressor may be selected so that it has a cloud point that is no greater than the deposition temperature. In a preferred embodiment of the invention, the suppressor is selected so that the cloud point matches the deposition temperature. If the cloud point is greater than the deposition temperature, an anion may be added to the composition to lower the cloud point to a temperature no greater than the electrodeposition temperature. In this example, for a deposition temperature of 21° C., the composition may comprise 67 g/L $CuSO_4.5H_2O$, 180 g/L $H_2SO_4$, 10 ml/L of 2% Pluronic® 31R1, 7 ml/L of 0.1% of the sodium salt of 3-mercaptopropane sulfonic acid and 50 ppm bromide. The components of the composition may be combined in any suitable order by any convenient method of mixing, such as, for example, by rapidly stirring with a mechanical stirrer or by agitating with a mechanical agitator.

Next, metal is electrodeposited onto the work piece from the electrochemical deposition composition. The electrodeposition occurs at the selected deposition temperature. Wafer carrier 68 urges work piece 66 against contact surface 62 such that work piece 66 engages contact surface 62 at a desired pressure. Preferably, wafer carrier 68 applies a uniform and constant pressure of approximately 1 psi or less, although it may be appreciated that any suitable pressure that promotes substantially planar deposition may be used. During the deposition process, the electrodeposition composition is delivered to the surface of contact surface 62 through channels 74. An electric potential is also applied to create a circuit between platen 64, the electrodeposition composition and work piece 66. The power source 70 may apply a constant current or voltage to the apparatus or, alternatively, the current or voltage could be modulated to apply different currents or voltages at predetermined times in the process or to modulate between a predetermined current or voltage and no current or no voltage. Wafer carrier 68 and work piece 66 may rotate about an axis 76 while platen 64 and contact surface 62 move in a rotational, orbital or linear pattern. In addition, wafer carrier 68 and work piece 66 may oscillate relative to contact surface 62. The electrodeposition process continues for a predetermined amount of time or until an endpoint detection apparatus indicates that a desired deposition thickness has been achieved.

Thus, it is apparent that there has been provided, in accordance with the invention, a composition and method for electrodeposition of a metal on a work piece that fully meets the needs set forth above. Although various embodiments of the invention have been described and illustrated with reference to specific embodiments thereof, it is not intended that the invention be limited to such illustrative embodiments. For example, while the above description of the invention focuses on the deposition of metal on semiconductor wafer, the invention is not to be interpreted as being applicable only to semiconductor wafers. Rather, the composition of the present invention may be employed in any suitable metal plating process that effects an electric potential between a cathode and an anode and can be used to plate metal on any suitable substrate or work piece. Further, while it may be desirable in certain applications to use the present invention to obtain a substantially planar surface of the deposited metal film overlying the work piece, it will be appreciated that the described invention is not limited to the deposition of substantially planar metal surfaces. The various embodiments of the present invention may be used to obtain non-planar surfaces, such as, for example, in conventional electroplating processes, wherein non-planar surfaces subsequently may or may not be planarized. Those of skill in the art will recognize that many variations and modifications of such embodiments are possible without departing from the spirit of the invention. Accordingly, it is intended to encompass within the invention all such modifications and variations as fall within the scope of the appended claims.

I claim:

1. A composition for substantially planar electrodeposition of a metal on, a work piece during an electrodeposition process, the composition comprising:

a metal salt comprising the metal;

a polymer suppressor having a cloud point that is greater than an electrodeposition temperature of the electrodeposition process;

an anion present in an amount sufficient to lower said cloud point to a temperature approximately no greater than said electrodeposition temperature;

an accelerator, and an electrolyte.

2. The composition of claim 1, said electrolyte comprising sulfuric acid.

3. The composition of claim 1, the work piece having a feature and a field, wherein the composition is formulated so that the rate of deposition of the metal within said feature is greater than the rate of deposition of the metal on said field.

4. The composition of claim 1, the work piece having a field and a feature, wherein the composition is formulated so that, at a time when a substantially planar metal film has been deposited overlying the work piece, and before any removal of said deposited metal film, a thickness of said metal film overlying said field is no greater than about 3000 angstroms.

5. The composition of claim 1, wherein said anion is polarizable in an electric field.

6. The composition of claim 1, wherein said anion is selected from the group consisting of chloride ions, bromide ions, iodide ions, sulfate ions, and combinations thereof.

7. The composition of claim 1, the work piece having a first field adjacent a feature at least 2 μm wide and having a second field adjacent a feature less than 2 μm wide, wherein said suppressor exhibits preferential adsorption on said first and said second fields.

8. The composition of claim 1, said polymer suppressor comprising a wetting agent.

9. The composition of claim 8, said polymer suppressor having a Draves wetting value in the range of about 1 to about 30 seconds.

10. The composition of claim 8, said polymer suppressor having a contact angle in the range of 0 to 60° as measured for up to 1 minute.

11. The composition of claim 1, said polymer suppressor having an hydrophilic/lipophilic balance (HLB) value in the range of from 1 to 15.

12. The composition of claim 1, said polymer suppressor comprising a block copolymer of ethylene oxide and propylene oxide.

13. The composition of claim 1, wherein said cloud point is in the range of about 10 to 100° C.

14. The composition of claim 1, the work piece having a first feature at least 2 μm wide and a second feature less than 2 μm wide, wherein said accelerator exhibits preferential adsorption on said first and said second features.

15. The composition of claim 1, the metal having a standard reduction potential, wherein said accelerator forms a complex with the metal, said complex having a reduction potential tat is less than said standard reduction potential.

16. The composition of claim 1, wherein said accelerator has the formula:

H—S—R, where R is an electron donating group.

17. The composition of claim 16, wherein said accelerator comprises a metal salt of 2-mercaptoethane sulfonic acid or a metal salt of 3-mercaptopropane sulfonic acid.

18. The composition of claim 1, wherein said metal salt is a salt comprising a metal selected from the group consisting of Cu, Al, Ni, Ta, Ti, W, Ag, Cu/Al, TaN, TiN, CoWP, NIP and CoP.

19. The composition of claim 1, the electrodeposition comprising electroplating or electrochemical mechanical deposition.

20. A composition for substantially planar electrodeposition of a metal on a work piece during an electrodeposition process, wherein the work piece has a first field adjacent a first feature approximately at least 2 μm wide and a second field adjacent a second feature less than 2 μm wide, the composition comprising:

a metal salt;

a polymer suppressor having a molecular weight of 1000 to 2 million and having a cloud point that is greater than an electrodeposition temperature of the electrodeposition process;

an anion present in an amount sufficient to lower said cloud point to a temperature approximately no greater than said electrodeposition temperature; an accelerator formulated for preferential adsorption on said first and second features; and an electrolyte, wherein the composition is formulated so that the rate of deposition of the metal within the first and second features is greater than the rate of deposition of the metal on the first and second fields.

21. The composition of claim 20, wherein the composition is formulated so that, at a time when a substantially planar metal film has been deposited overlying the work piece, and before any removal of said deposited metal film, a thickness of said metal film overlying the first and second fields is no greater than about 3000 angstroms.

22. The composition of claim 20, the electrodeposition comprising electroplating or electrochemical mechanical deposition.

23. A method for substantially planar electrodeposition of a metal on a work piece, the method comprising:

selecting an electrodeposition temperature;

formulating an electrochemical deposition composition, said step of formulating comprising combining:

a metal salt;

a polymer suppressor having a cloud point that is no less than said electrodeposition temperature;

an anion in an amount sufficient to lower said cloud point to a temperature approximately no greater than said electrodeposition temperature if said cloud point is greater than said electrodeposition temperature;

an accelerator; and an electrolyte; and electrodepositing a substantially planar metal layer onto said work piece from said electrochemical deposition composition, said electrodepositing occurring with said electrochemical deposition composition at about said electrodeposition temperature.

24. The method of claim 23, the step of combining comprising the step of selecting said polymer suppressor so that said cloud point substantially matches said electrodeposition temperature.

25. The method of claim 23, the step of combining a metal salt, a polymer suppressor having a cloud point that is no less than said electrodeposition temperature, an anion in an amount sufficient to lower said cloud point to a temperature approximately no greater than said electrodeposition temperature if said cloud point is greater than said electrodeposition temperature, an accelerator, and an electrolyte comprising the step of combining said metal salt, said polymer suppressor, said anion, wherein said anion is polarizable in an electric field, said accelerator, and said electrolyte.

26. The method of claim 25, the step of combining said metal salt, said polymer suppressor, said anion, wherein said anion is polarizable in an electric field, said accelerator, and said electrolyte comprising the step of combining said metal salt, said polymer suppressor, said anion, wherein said anion is selected from the group consisting of chloride ions, bromide ions, iodide ions, sulfate ions, and combinations thereof, said accelerator, and said electrolyte.

27. The method of claim 23, the step of electrodepositing comprising electroplating.

28. The method of claim 23, the step of electrodepositing comprising depositing by electrochemical mechanical deposition.

29. The method of claim 28, the step of depositing by electrochemical mechanical deposition comprising causing said work piece to experience pressure from a contact surface, said pressure no greater than 1 psi.

30. The method of claim 23, the step of electrodepositing comprising applying a constant current, a constant voltage, a modulated current or a modulated voltage.

31. A composition for substantially planar electrodeposition of a metal on a work piece during an electrodeposition process, wherein the work piece has a field and a feature, the composition comprising:

a metal salt;

a first polymer suppressor having a cloud point that is no less than an electrodeposition temperature of the electrodeposition process;

a second polymer suppressor, said first and second polymer suppressors having molecules of a first and second average size, respectively, said first average size different from said second average size;

an anion present in an amount sufficient to lower said cloud point to a temperature approximately no greater than said electrodeposition temperature;

an accelerator; and an electrolyte.

32. The composition of claim 31, said first polymer suppressor having a contact angle in the range of 0 to 60° as measured for up to 1 minute.

33. The composition of claim 31, said first polymer suppressor having an hydrophilic/lipophilic balance (HLB) value in the range of from 1 to 15.

34. The composition of claim 31, said first polymer suppressor comprising a block copolymer of ethylene oxide and propylene oxide.

35. The composition of claim 31, wherein said accelerator has the formula:

H—S—R, where R is an electron-donating group.

36. The composition of claim 31, wherein said accelerator comprises one of a metal salt of 2-mercaptoethane sulfonic acid or a metal salt of 3-mercaptopropane sulfonic acid.

37. A method for formulating a composition for substantially planar electrodeposition of a metal on a work piece, which electrodeposition is conducted at an electrodeposition temperature, the method comprising:

selecting a polymer suppressor having a cloud point that is no less than the electrodeposition temperature; and combining:

said polymer suppressor;

an anion in an amount sufficient to lower said cloud point to a temperature approximately no greater than the electrodeposition temperature;

a metal salt;

an accelerator; and an electrolyte.

38. The method of claim 37, the step of combining comprising the step of combining said polymer suppressor, said anion, said metal salt, said electrolyte and said accelerator, wherein said accelerator is formed from a metal salt of 2-mercaptoethane sulfonic acid or a metal salt of 3-mercaptopropane sulfonic acid.

39. A method for electrodeposition of a metal on a work piece, the method comprising:

selecting an electrodeposition temperature;

formulating an electrochemical deposition composition, said step of formulating comprising combining:

a metal salt;

a polymer suppressor having a cloud point that is no less than said electrodeposition temperature;

an accelerator;

an electrolyte; and an anion in an amount sufficient to lower said cloud point to a temperature no greater than said electrodeposition temperature; and electrodepositing a metal film onto said work piece from said electrochemical deposition composition until a substantially planar surface of said metal film is achieved, wherein said substantially planar surface is achieved without removal of a portion of said metal film.

* * * * *

UNITED STATES PATENT AND TRADEMARK OFFICE

CERTIFICATE OF CORRECTION

PATENT NO. : 7,105,082 B2
APPLICATION NO. : 10/377488
DATED : September 12, 2006
INVENTOR(S) : Vishwas Hardikar It is certified that error appears in the above-identified patent and that said Letters Patent is hereby corrected as shown below:

In Column 9, Line 36, delete “metal on,” and add -- metal on --; and
In Column 10, Line 27, delete “tat” and add -- that --.

Signed and Sealed this

Twelfth Day of December, 2006

JON W. DUDAS
*Director of the United States Patent and Trademark Office*